US010674817B1

(12) United States Patent
Cao

(10) Patent No.: US 10,674,817 B1
(45) Date of Patent: Jun. 9, 2020

(54) MULTIFUNCTIONAL BREATHABLE STORAGE CABINET

(71) Applicant: Xin Cao, Hunan (CN)

(72) Inventor: Xin Cao, Hunan (CN)

( * ) Notice: Subject to any disclaimer, the term of this patent is extended or adjusted under 35 U.S.C. 154(b) by 0 days.

(21) Appl. No.: 16/452,552

(22) Filed: Jun. 26, 2019

(30) Foreign Application Priority Data

Jun. 18, 2019 (CN) ..... 2019 2 0912252 U

(51) Int. Cl.

| | |
|---|---|
| ***B65D 6/08*** | (2006.01) |
| ***A47B 55/02*** | (2006.01) |
| ***A47F 5/10*** | (2006.01) |
| ***A47B 88/40*** | (2017.01) |

(52) U.S. Cl.
CPC ..... *A47B 55/02* (2013.01); *A47B 88/40* (2017.01); *A47B 2088/401* (2017.01)

(58) Field of Classification Search
CPC ..... A47B 88/40; A47B 55/02; B65D 7/14
See application file for complete search history.

(56) References Cited

U.S. PATENT DOCUMENTS 3,007,708 A * 11/1961 Ochs ..... A47B 55/02 280/33.998
4,509,805 A * 4/1985 Welsch ..... A47F 5/135 312/210
4,974,524 A * 12/1990 Long, II ..... A47B 55/02 108/107
5,573,124 A * 11/1996 Frost ..... A47F 5/083 211/106
5,722,544 A * 3/1998 Williams ..... A47B 87/008 108/107
6,457,595 B1 * 10/2002 Pritchard ..... A47F 5/13 108/108
6,851,771 B2 * 2/2005 Marler ..... E04H 1/1238 119/452
7,228,985 B2 * 6/2007 Yeh ..... B62D 25/084 220/485
8,006,858 B2 * 8/2011 Cheng ..... A47B 55/02 220/485
8,141,737 B1 * 3/2012 Tsai ..... B65D 7/14 220/485
8,550,277 B2 * 10/2013 Gronholm ..... B65D 19/10 220/4.01

(Continued)

FOREIGN PATENT DOCUMENTS

WO WO-9519122 A1 * 7/1995 ..... A47L 15/50

*Primary Examiner* — Kimberley S Wright

(57) ABSTRACT

A multifunctional breathable storage cabinet, including a frame body having a left frame and a right frame, and at least one set of sliding rails correspondingly mounted on the left frame and the right frame; a storage laminate or a storage basket capable of sliding along the sliding rail is mounted on the sliding rail; one inward end of the sliding rail is provided with a baffle, and the inner wall of one outward end of the sliding rail is provided with an elastic limiting device; the storage basket includes a sliding connecting piece capable of being inserted in the sliding rail and sliding along the sliding rail and a metal mesh storage basket body connected with the sliding connecting piece, and the sliding connecting piece is provided with a limiting protrusion capable of being in contact with the elastic limiting device to limit the storage basket.

5 Claims, 19 Drawing Sheets

(56) References Cited

U.S. PATENT DOCUMENTS

| | | | | |
|---|---|---|---|---|
| 8,764,031 | B2 * | 7/2014 | Finstad, III | A47B 57/06 211/187 |
| 9,737,141 | B2 * | 8/2017 | Johnson | A47B 55/02 |
| 2005/0077299 | A1 * | 4/2005 | Cheng | A47B 55/02 220/485 |
| 2008/0193247 | A1 * | 8/2008 | Zupancich | B65D 19/10 410/92 |
| 2009/0045201 | A1 * | 2/2009 | Cheng | A47B 55/02 220/494 |
| 2011/0204760 | A1 * | 8/2011 | Finstad, III | A47B 57/06 312/311 |
| 2012/0168433 | A1 * | 7/2012 | Cheng | A47B 55/02 220/4.01 |
| 2013/0126452 | A1 * | 5/2013 | Lo | A47B 67/04 211/79 |
| 2014/0042113 | A1 * | 2/2014 | Cheng | A47B 55/02 211/126.15 |
| 2017/0071362 | A1 * | 3/2017 | Marler | B62B 3/004 |

* cited by examiner

MULTIFUNCTIONAL BREATHABLE STORAGE CABINET

BACKGROUND OF THE INVENTION

The utility model relates to the technical field of storage cabinets, and more particularly to a multifunctional breathable storage cabinet.

Storage in daily life or at work and tidying of daily necessities needs storage cabinets for storage. However, most of existing storage cabinets are wooden storage cabinets, which require the consumption of a lot of wood and are not environmentally friendly. The storage cabinets are very heavy. A storage laminate or a storage drawer in the storage cabinet is of an airtight structure, the breathability is poor, which is unfavorable for ventilation of placed articles, and the articles are prone to mold and odor and the like; at the same time, it is very difficult to dismantle the existing storage cabinet, and the occupied space is large when the storage cabinet is transported or does not need to be used, which increases transportation costs and easily causes deformation or damage during transportation.

BRIEF SUMMARY OF THE INVENTION

An objective of the utility model is to overcome the above-mentioned defects in the prior art, and provide a breathable storage cabinet which can cave wood, protects the environment, has good gas breathability, prevents articles from molding and stinking easily, achieves detachable connection of a frame body, enables the frame body to be detached for transportation or storage during the transportation or when unused, effectively reduces the space occupied during transportation or storage, greatly reduces transportation costs, facilitates assembly of the frame body, and is simple to operate and convenient to disassemble and assemble.

In order to achieve the above objective, the technical solution provided by the utility model is as follows: A multifunctional breathable storage cabinet includes a frame body. The frame body includes a left frame and a right frame, and at least one set of sliding rails is correspondingly mounted on the left frame and the right frame; a storage laminate or a storage basket capable of sliding along the sliding rail is mounted on the sliding rail; one inward end of the sliding rail is provided with a baffle, and the inner wall of one outward end of the sliding rail is provided with an elastic limiting device; the storage basket includes a sliding connecting piece capable of being inserted in the sliding rail and sliding along the sliding rail and a metal mesh storage basket body connected with the sliding connecting piece, and the sliding connecting piece is provided with a limiting protrusion capable of being in contact with the elastic limiting device to limit the storage basket. The metal mesh storage basket body is formed by bending and welding a metal mesh with openings at four corners or formed by welding a first metal mesh, a second metal mesh and a third metal mesh, and an upper edge of the metal mesh storage basket body is inserted in an insertion groove of the sliding connecting piece and fixedly connected with the sliding connecting piece or the upper edge of the metal mesh storage basket body is welded to the sliding connecting piece.

Preferably, the frame body further comprises an upper frame, a lower frame and a rear frame; the tops of the left frame and the right frame are respectively provided with at least one first connecting piece, the bottom of the upper frame is provided with a first opening adapted to the first connecting piece, the first connecting piece is inserted in the first opening to connect the left frame and the right frame with the upper frame, the bottom of the lower frame is provided with at least one second connecting piece, the bottoms of the left frame and the right frame are provided with second openings adapted to the second connecting piece, the second connecting piece is inserted in the second opening to connect the left frame and the right frame with the lower frame, and the rear frame is connected with the rear of the left frame and the rear of the right frame through fasteners.

Preferably, the frame body further comprises an upper frame, a lower frame and a rear frame; the left frame is formed by inserting a first left frame unit and a second left frame unit, and the right frame is formed by inserting a first right frame unit and a second right frame unit; the first left frame unit, the upper frame and the first right frame unit are integrally bent into an inverse U shape through a metal mesh; the second left frame unit, the lower frame and the second right frame unit are integrally bent into a U shape through a metal mesh; the bottoms of the first left frame unit and the first right frame unit are respectively provided with at least one third connecting piece; the second left frame unit and the second right frame unit are provided with third openings adapted to the third connecting piece; reinforcing pipes welded to the metal meshes are mounted at the end of the first left frame unit corresponding to the second left frame unit and the end of the first right frame unit corresponding to the second right frame unit respectively; reinforcing parts are mounted on a corner between the upper frame and the first left frame unit and a corner between the upper frame of the first right frame unit; and the rear frame is connected with the rear of the left frame and the rear of the right frame through fasteners.

Preferably, the frame body further comprises an upper frame and a rear frame; the tops of the left frame and the right frame are respectively provided with at least one first connecting piece, the bottom of the upper frame is provided with a first opening adapted to the first connecting piece, and the first connecting piece is inserted in the first opening to connect the left frame and the right frame with the upper frame; connecting rod assemblies capable of folding the left frame and the right frame are disposed on the lower portions of the left frame and the right frame, and the rear frame is connected with the rear of the left frame and the rear of the right frame through fasteners.

Preferably, the rear frame is of a metal mesh structure, two side edges of the rear frame are respectively folded to form folded reinforcing portions, two side edges of the rear frame are provided with arc-shaped concave portions respectively, and V-shaped strips for coating the upper end and the lower end of the rear frame are mounted at the upper end and the lower end of the rear frame respectively.

Preferably, the left frame and the right frame are each of a metal mesh structure, and two side edges of the left frame and the right frame are respectively bent to form hollow columnar supporting columns.

Compared with the prior art, the utility model has the following beneficial effects:

1. The utility model is simple in structure, the frame body includes a left frame and a right frame, and at least one set of sliding rails is correspondingly mounted on the left frame and the right frame; a storage laminate or a storage basket capable of sliding along the sliding rail is mounted on the sliding rail; one inward end of the sliding rail is provided with a baffle, and the inner wall of one outward end of the sliding rail is provided with an elastic limiting device; the storage basket can slide along the sliding rail and is provided with a limiting protrusion, and the storage basket is positioned through the cooperation of the limiting protrusion and the elastic limiting device, so that the storage basket is prevented from being pulled out of the sliding rail; under the conditions that no rear frame is arranged, the storage cabinet can be made into an open storage cabinet with the front and rear provided with openings; the rear frame can also be arranged, so that the storage cabinet is made into a storage cabinet with the front provided with an opening; the rear frame is detachably connected with the left frame and the right frame through fasteners, the left frame and the right frame are detachably connected with an upper frame through a first connecting piece, and the left frame and the right frame are detachably connected with a lower frame through a second connecting piece. In this way, the detachable connection of the frame body is achieved, and the frame body can be detached for transportation or storage during the transportation or when unused, which effectively reduces the space occupied during transportation or storage and greatly reduces transportation costs; the assembly of the frame body is facilitated, and the operation is simple.

2. The frame body of the utility model can be designed to have a rear frame or no rear frame, and have a lower frame or no lower frame. The left frame and the right frame are folded or unfolded through a connecting rod assembly, and the frame body can be designed into different frame body structures according to users' requirements, thereby effectively meeting the market demand.

3. The upper frame, the lower frame, the left frame, the right frame, a front frame and a rear frame in the utility model are each of a metal mesh structure, which effectively ensures the ventilation and breathability of the inside of the frame body and prevents articles stored in the frame body from molding; and two side edges of the metal mesh can be bent to increase the strength of each frame, thereby effectively ensuring the production quality of the product.

4. The upper frame, the lower frame, the left frame, the right frame, the front frame and the rear frame are each of a metal mesh structure, which can save wood and protect the environment; the metal meshes are integrally formed by stamping and stretching, which saves metal materials, the cost is low, and the weight is light.

BRIEF DESCRIPTION OF THE DRAWINGS

In order to more clearly illustrate the embodiments of the utility model or the technical solutions in the prior art, the accompanying drawings that need to be used in description of the embodiments or the prior art will be briefly introduced below. Obviously, the accompanying drawings in the following description illustrate some embodiment of the utility model, and for those of ordinary skill in the art, other accompanying drawings can also be obtained according to these accompanying drawings without any creative work.

DETAILED DESCRIPTION OF THE INVENTION

Figure 1:
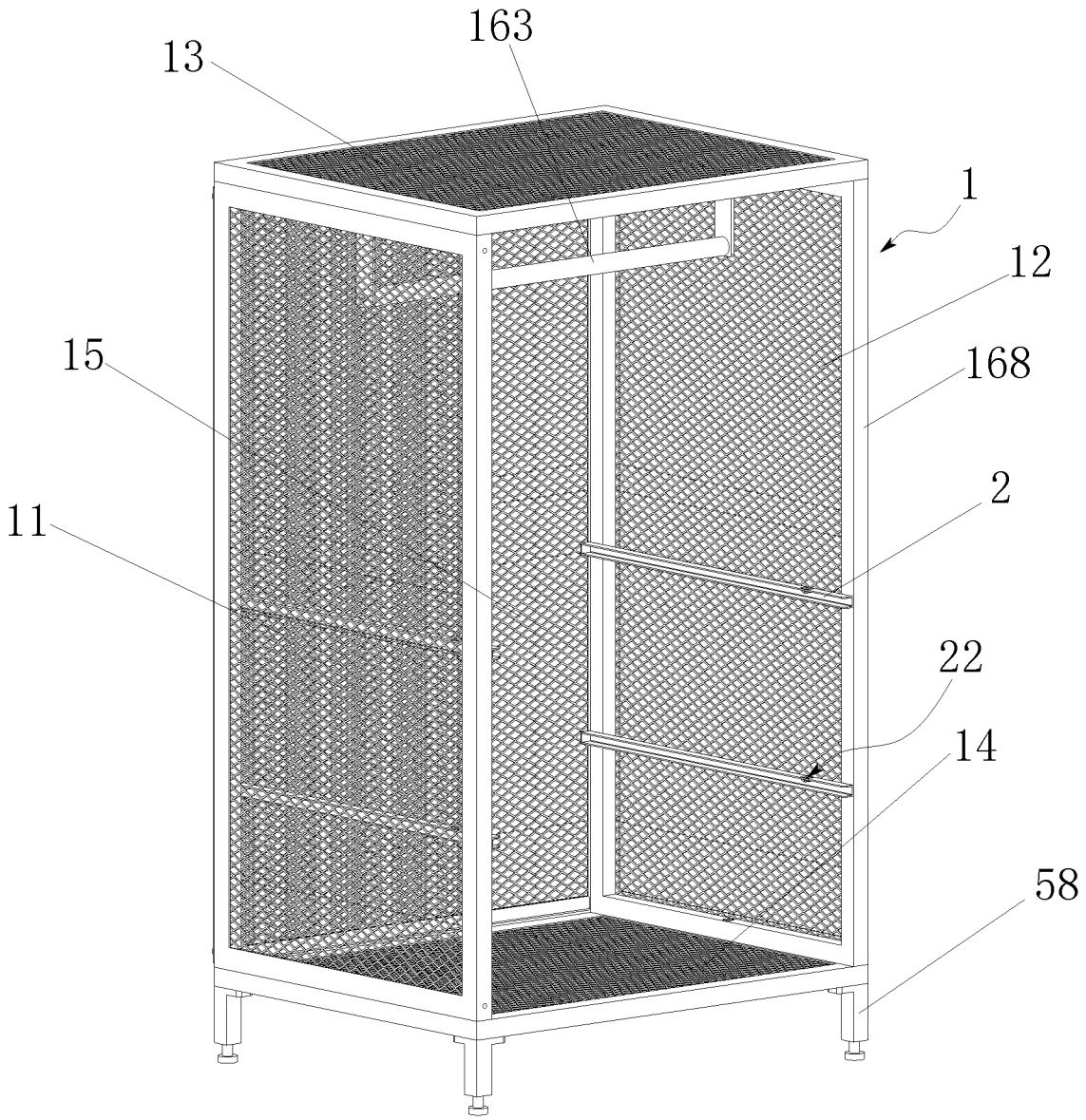
FIG. 1 is a stereoscopic schematic structural view of a multifunctional breathable storage cabinet without a storage basket according to Embodiment 1 of the utility model.

In order to make the objectives, technical solutions and advantages of the embodiments of the utility model clearer, the technical solutions in the embodiments of the utility model will be clearly and completely described below in conjunction with the accompanying drawings in the embodiments of the utility model. Apparently, the described embodiments are some embodiments of the utility model rather than all embodiments. All other embodiments obtained by those or ordinary skill in the art based on the embodiments of the utility model without creative efforts are within the protection scope of the utility model.

Embodiment 1

Referring to FIGS. 1 to 19, a multifunctional breathable storage cabinet according to an embodiment of the utility model includes a frame body 1, the frame body 1 includes a left frame 11 and a right frame 12, and at least one set of sliding rails 2 is corresponding mounted on the left frame 11 and the right frame 12; a storage basket 4 capable of sliding along the sliding rail 2 is mounted on the sliding rail 2; one inward end of the sliding rail 2 is provided with a baffle 21, and the inner wall of one outward end of the sliding rail 2 is provided with an elastic limiting device 22; the storage basket 4 includes a sliding connecting piece 41 capable of being inserted in the sliding rail 2 and sliding along the sliding rail 2 and a metal mesh storage basket body 42 connected with the sliding connecting piece 41, and the sliding connecting piece 41 is provided with a limiting protrusion 43 capable of being in contact with the elastic limiting device 22 to limit the storage basket 4; the metal mesh storage basket body 42 is formed by welding a first metal mesh 45, a second metal mesh 46 and a third metal mesh 47, and an upper edge of the metal mesh storage basket body is inserted in an insertion groove 48 of the sliding connecting piece 41 and fixedly connected with the sliding connecting piece 41. The embodiment will be described in detail below with reference to the accompanying drawings.

Figure 2:
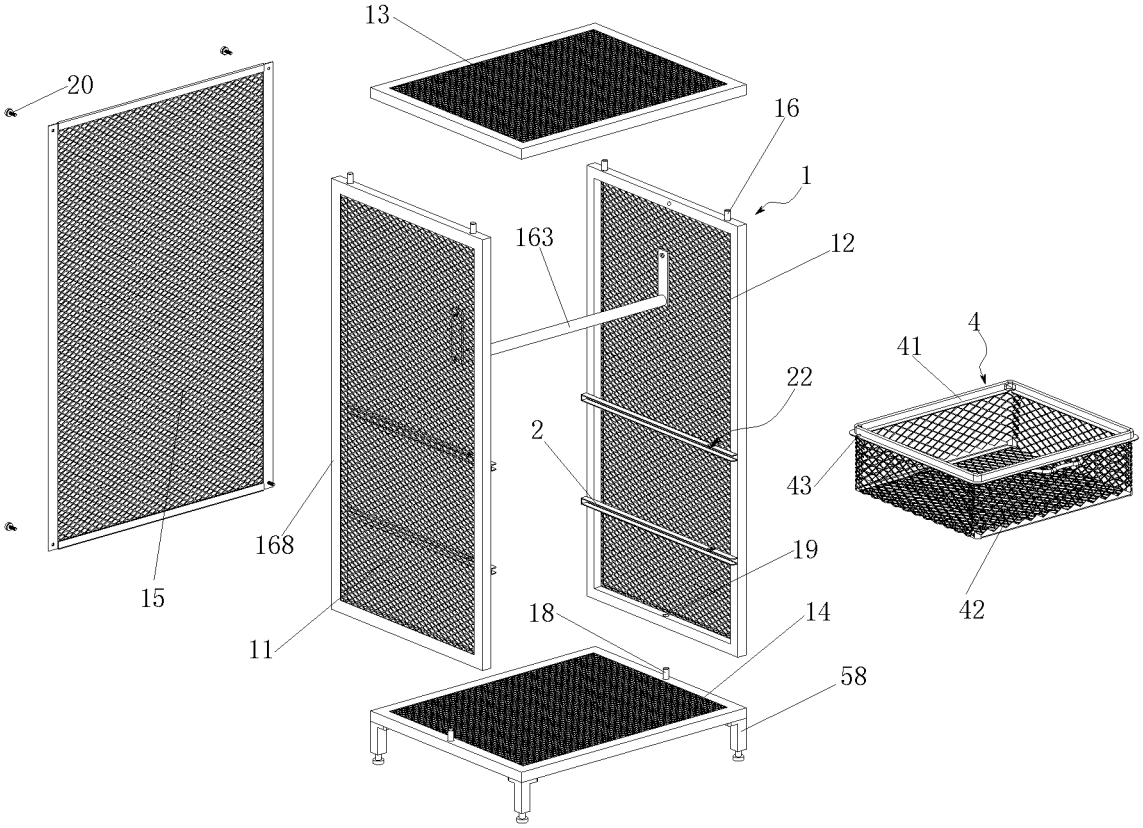
FIG. 2 is an exploded schematic structural view of a multifunctional breathable storage cabinet with a storage basket according to Embodiment 1 of the utility model.

In the embodiment, as shown in FIGS. 1 to 2, the frame body 1 further includes an upper frame 13, a lower frame 14 and a rear frame 15; the tops of the left frame 11 and the right frame 12 are respectively provided with at least one first connecting piece 16, the bottom of the upper frame 13 is provided with a first opening 17 adapted to the first connecting piece 16, the first connecting piece 16 is inserted in the first opening 17 to connect the left frame 11 and the right frame 12 with the upper frame 13, the bottom of the lower frame 14 is provided with at least one second connecting piece 18, the bottoms of the left frame 11 and the right frame 12 are provided with second openings 19 adapted to the second connecting piece 18, the second connecting piece 18 is inserted in the second opening 19 to connect the left frame 11 and the right frame 12 with the lower frame 14, and the rear frame 15 is connected with the rear of the left frame 11 and the rear of the right frame 12 through fasteners 20. In this way, the detachable connection of the frame body 1 is achieved, and the frame body 1 can be detached for transportation or storage during the transportation or when unused, which effectively reduces a space occupied during transportation or storage and greatly reduces transportation costs; the assembly and disassembly of the frame body are facilitated, and the operation is simple.

Each frame is of a metal mesh structure, which is good in breathability and prevents articles stored in the frame body from molding.

Figure 6:
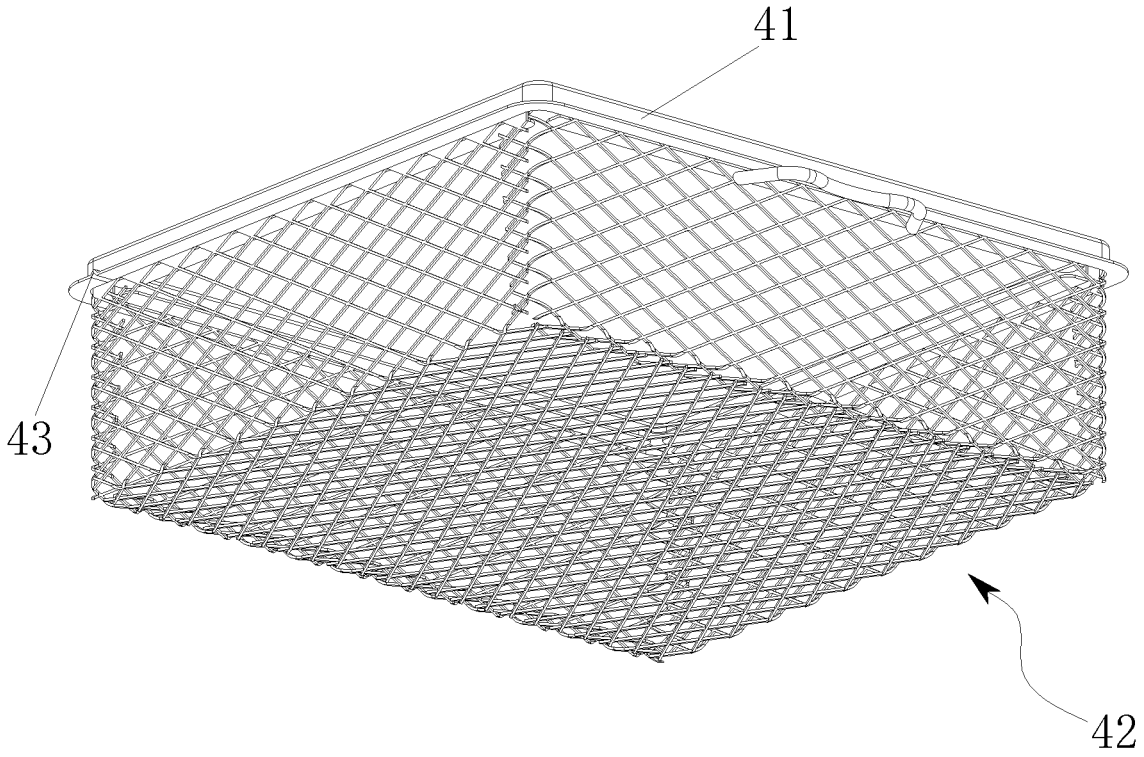
FIG. 6 is a stereoscopic schematic structural view of a first storage basket of a multifunctional breathable storage cabinet according to the utility model.
Figure 7:
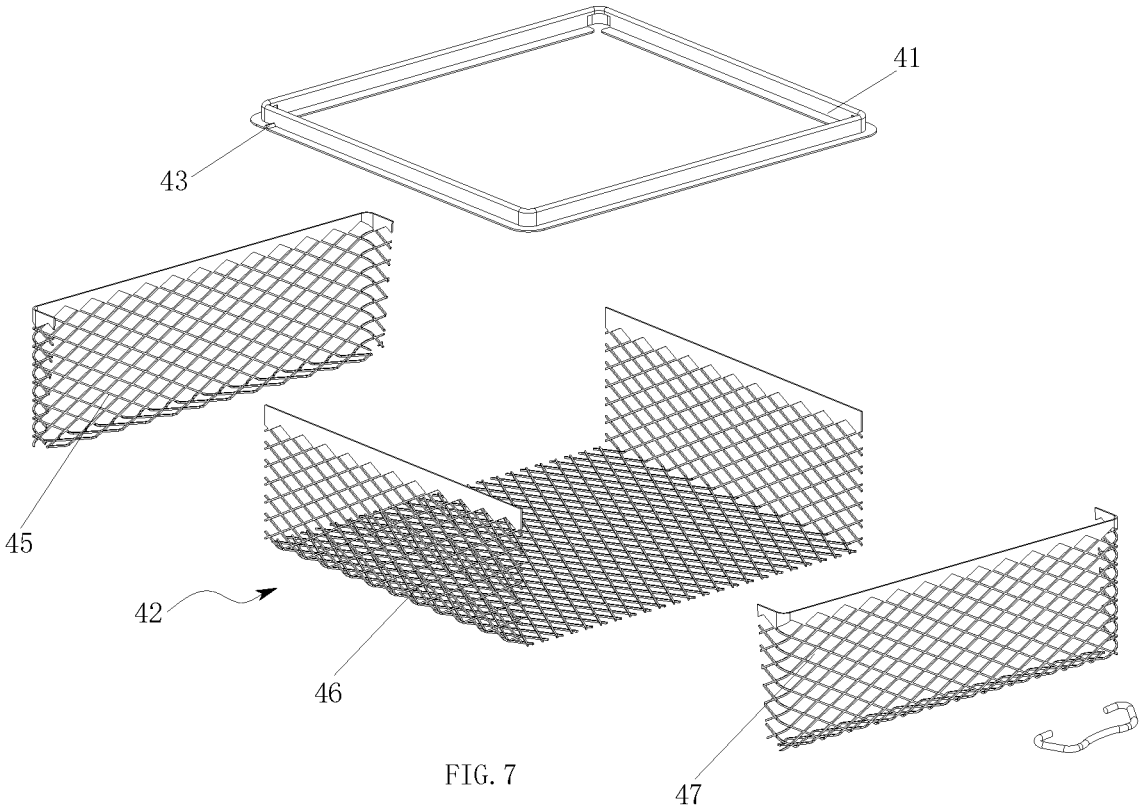
FIG. 7 is an exploded schematic structural view of FIG. 6.

As shown in FIGS. 6 and 7, the storage basket 4 includes a sliding connecting piece 41 capable of being inserted in the sliding rail 2 and sliding along the sliding rail 2 and a metal mesh storage basket body 42 connected with the sliding connecting piece 41, and the sliding connecting piece 41 is provided with a limiting protrusion 43 capable of being in contact with the elastic limiting device 22 to limit the storage basket 4; and the metal mesh storage basket body 42 is formed by welding a first metal mesh 45, a second metal mesh 46 and a third metal mesh 47. The metal mesh storage basket 42 formed by welding the three metal meshes is very suitable for the storage basket 4 with a larger depth, which facilitates forming and reduces production costs.

Figure 4:
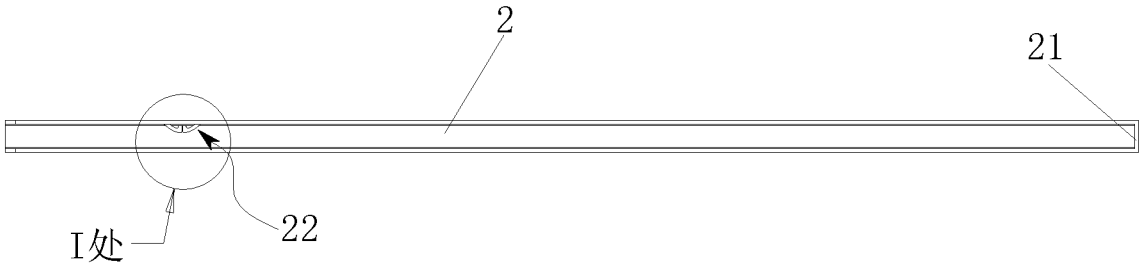
FIG. 4 is a schematic structural view of a sliding rail of a multifunctional breathable storage cabinet without a storage basket according to the utility model.
Figure 5:
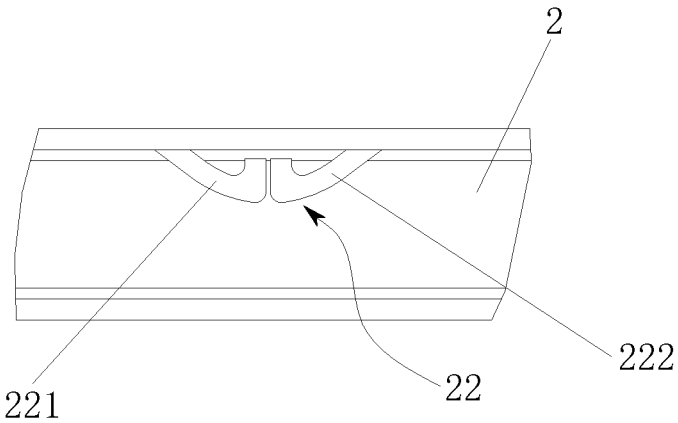
FIG. 5 is an enlarged view of an I position of FIG. 4.

As shown in FIGS. 4 to 5, the inner wall of one outward end of the sliding rail 2 is provided with an elastic limiting device 22, and the elastic limiting device 22 includes a first elastic piece 221 and a second elastic piece 222; one end of the first elastic piece 221 and one end of the second elastic piece 222 are connected to the sliding rails 2 respectively, and the other end of the first elastic piece 221 and the other end of the second elastic piece 222 are free ends. When the storage basket 4 is pulled out of the frame body 1 along the sliding rail 2 and the limiting protrusion 43 on the sliding connecting piece 41 is in contact with the elastic limiting device 22, the storage basket 4 is limited, and a double-spring structure is adopted to reinforce the elasticity of the elastic limiting device, so that the storage basket 4 is inserted into the sliding rail 2 and limited.

Figure 8:
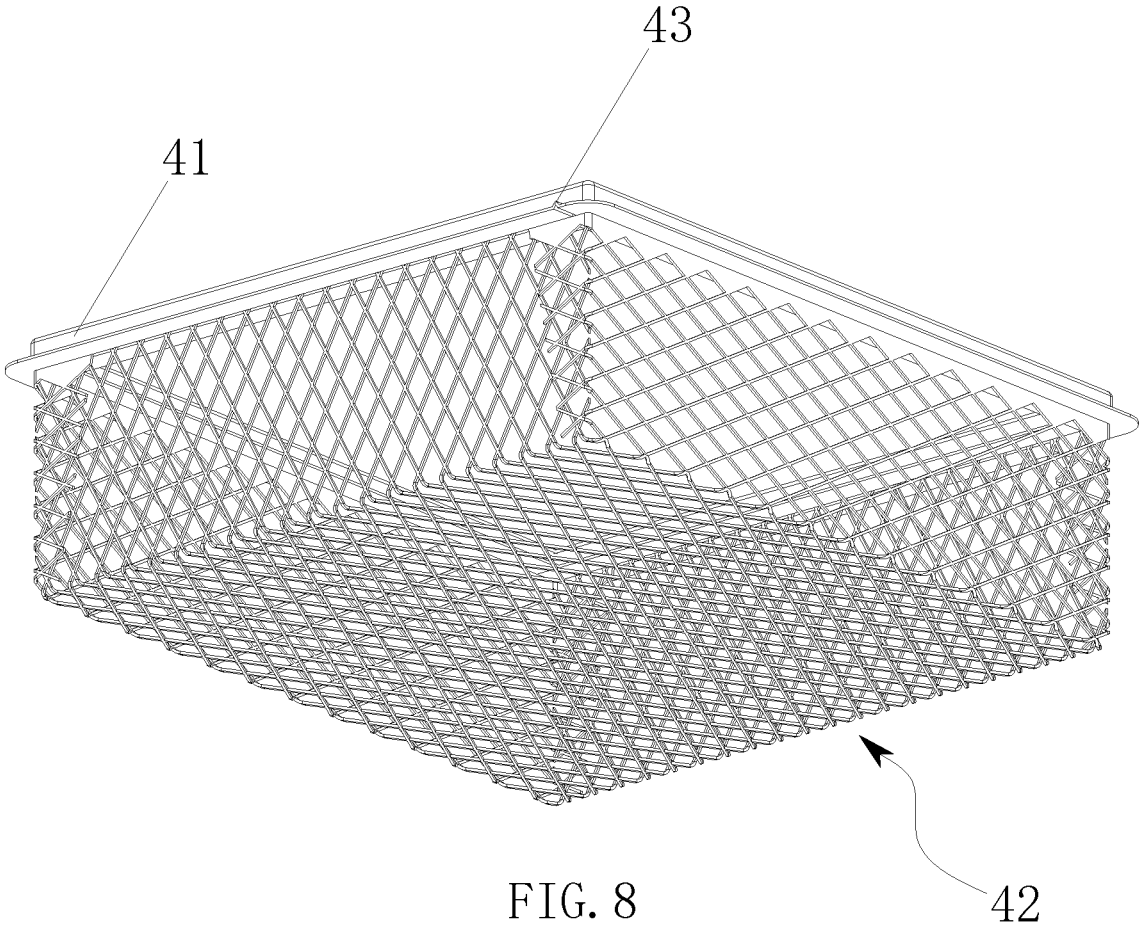
FIG. 8 is a stereoscopic schematic structural view of a second storage basket of a multifunctional breathable storage cabinet according to the utility model.
Figure 9:
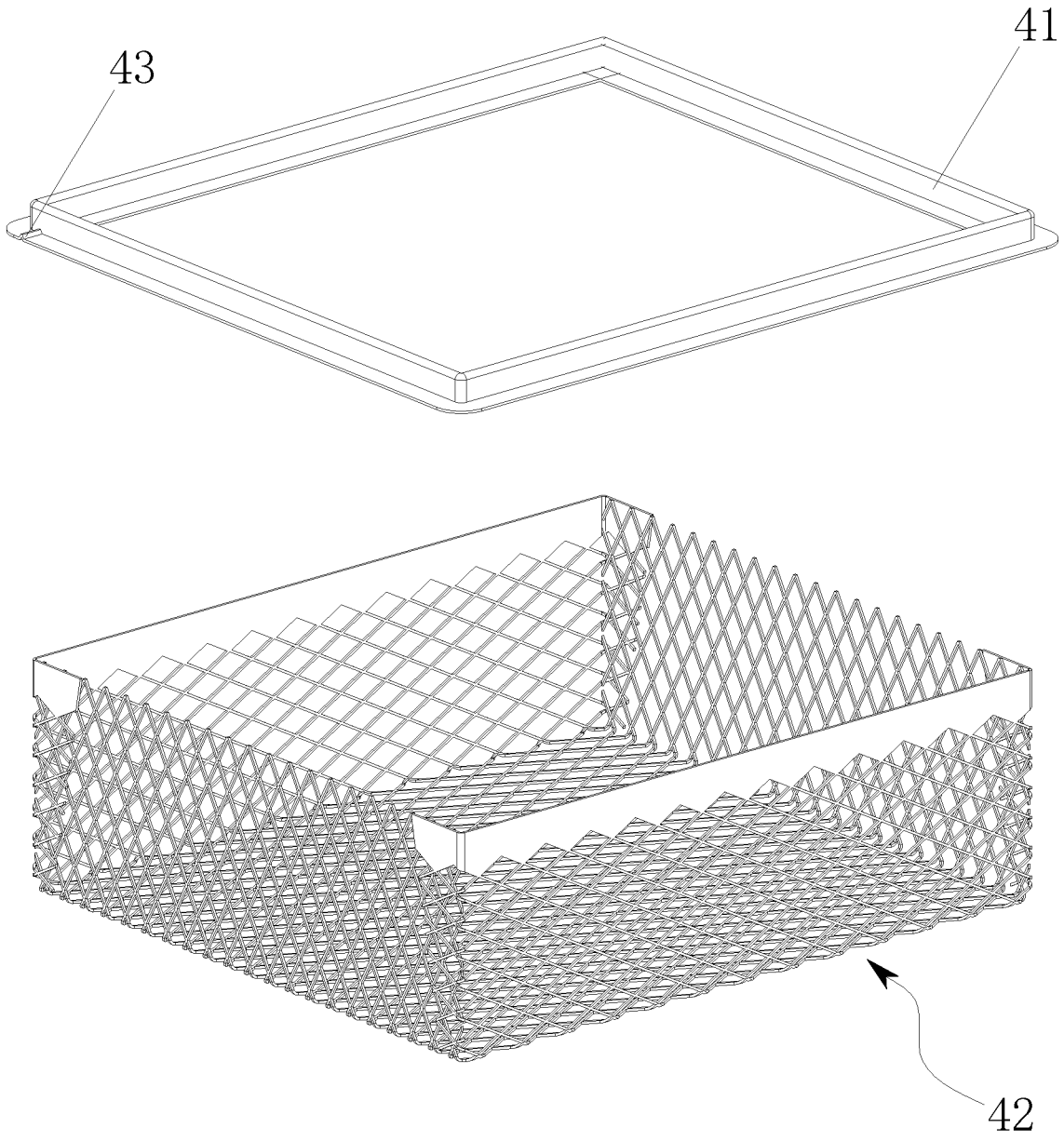
FIG. 9 is an exploded schematic structural view of FIG. 8.
Figure 10:
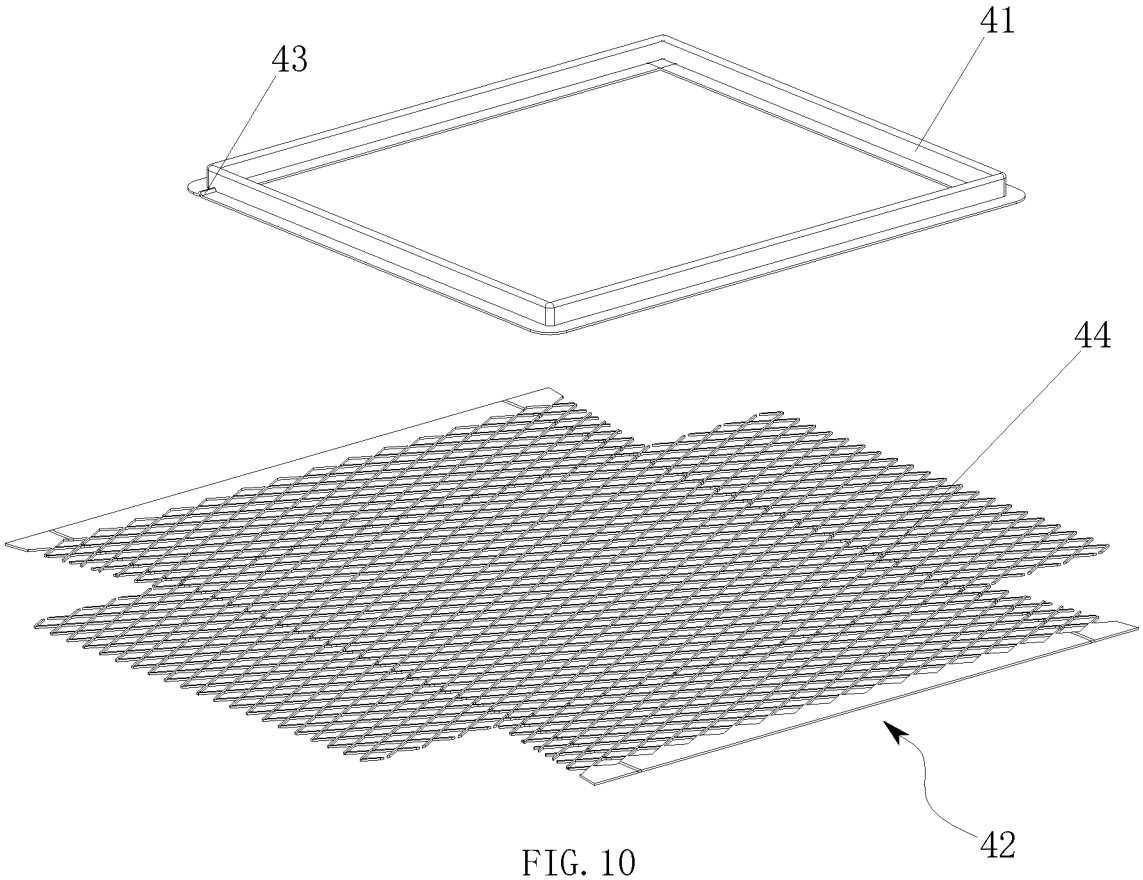
FIG. 10 is a schematic structural view of an unbent and non-welded metal mesh storage basket body of the second storage basket of a multifunctional breathable storage cabinet according to the utility model.

As another implementation of the embodiment, as shown in FIG. 8, FIG. 9 and FIG. 10, the metal mesh storage basket 42 is formed by bending and welding a metal mesh 44 with four corners provided with openings and does not need to be formed by welding three metal meshes. The metal mesh storage basket body 42 formed by bending and welding the metal mesh 44 with the four corners provided with the openings is suitable for the storage basket 4 with a smaller depth and saves cost.

Figure 11:
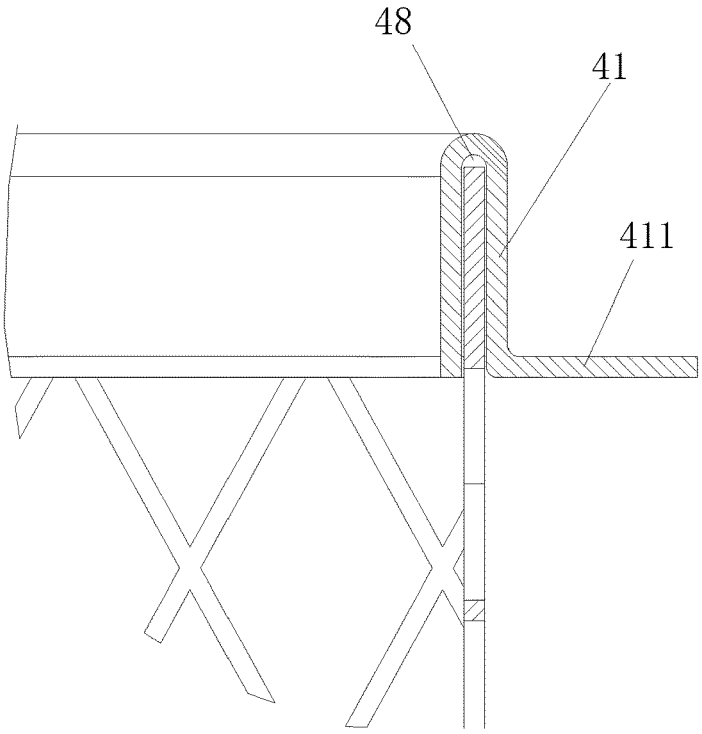
FIG. 11 is a first structural view of an insertion structure of a metal mesh storage basket body and a sliding connecting piece of a multifunctional breathable storage cabinet according to the utility model.
Figure 12:
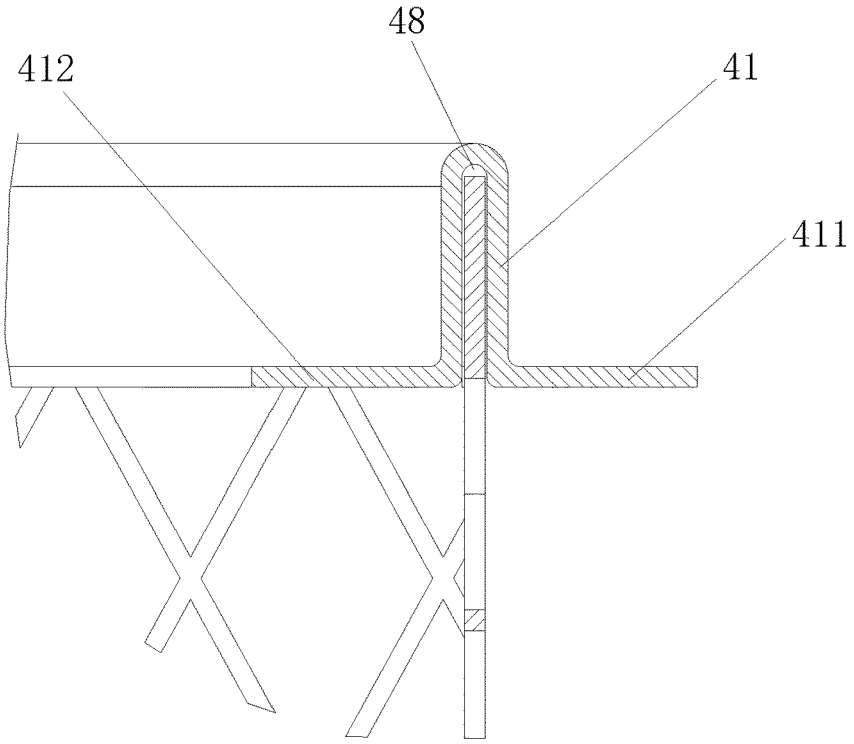
FIG. 12 is a second structural view of an insertion structure of a metal mesh storage basket body and a sliding connecting piece of a multifunctional breathable storage cabinet according to the utility model.

As shown in FIG. 11, the outer side of the sliding connecting piece 41 is provided with a sliding portion 411 capable of being inserted in the sliding rail 2 and sliding on the sliding rail 2. Preferably, as shown in FIG. 12, the inner side of the sliding connecting piece 41 is further provided with a convex edge 412 for supporting a cover. The cover is placed on the convex edge 412 to cover an object in the metal mesh storage basket body 42, and the metal mesh storage basket body 42 is connected with the sliding connecting piece 41 in an inserted and squeezed mode.

Figure 13:
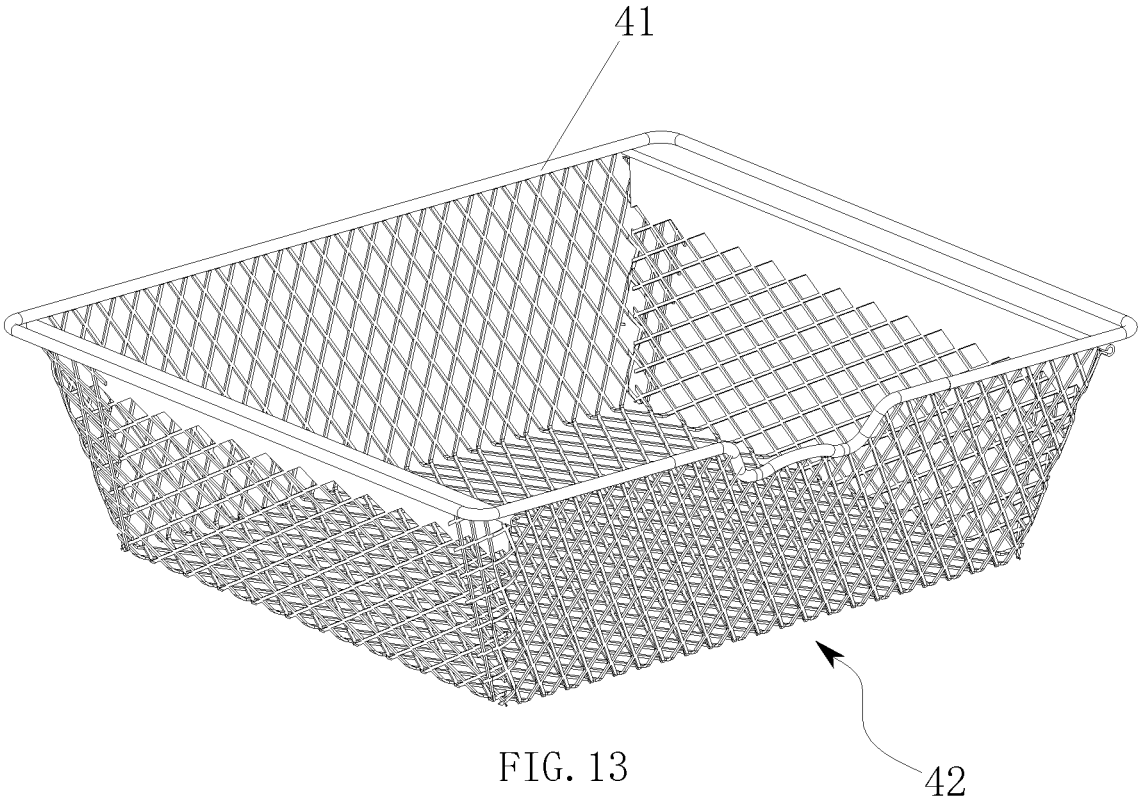
FIG. 13 is a second structural view of a welded structure of a metal mesh storage basket body and a sliding connecting piece of a multifunctional breathable storage cabinet according to the utility model.
Figure 14:
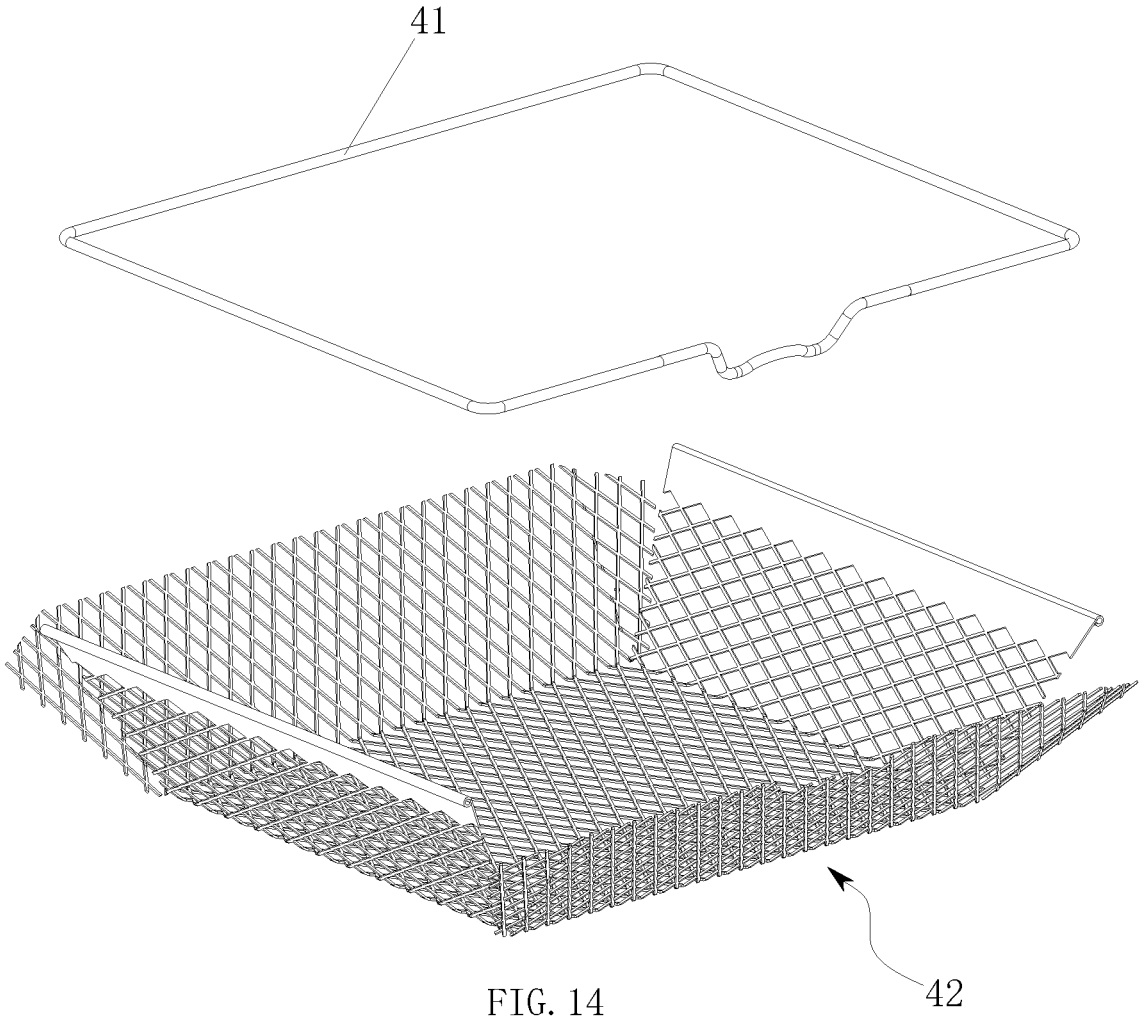
FIG. 14 is an exploded schematic structural view of FIG. 13.

As another implementation of the embodiment, as shown in FIGS. 13 and 14, the upper edge of the metal mesh storage basket body 42 can further be connected with the sliding connecting piece 41 in a welded mode.

Figure 15:
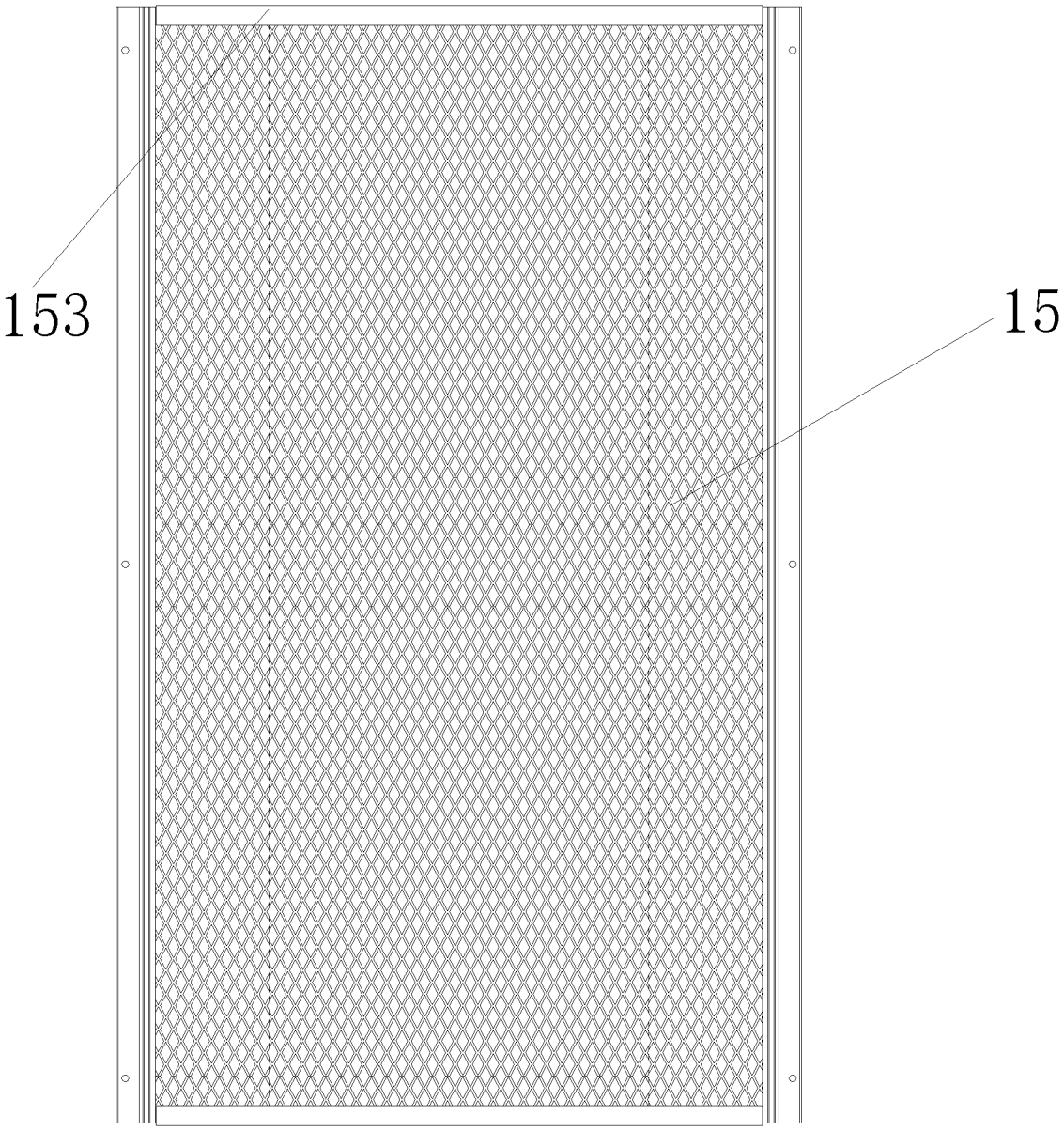
FIG. 15 is a schematic structural view of a rear frame of a multifunctional breathable storage cabinet according to the utility model.
Figure 16:
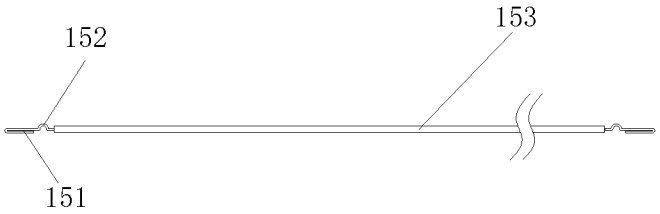
FIG. 16 is a vertical view of FIG. 15.

As shown in FIGS. 15 and 16, the rear frame 15 is of a metal mesh structure, two side edges of the rear frame 15 are respectively folded to form folded reinforcing portions 151, two side edges of the rear frame 15 are provided with arc-shaped concave portions 152 respectively, and V-shaped strips 153 for coating the upper end and the lower end of the rear frame are mounted at the upper end and the lower end of the rear frame 15 respectively.

Figure 17:
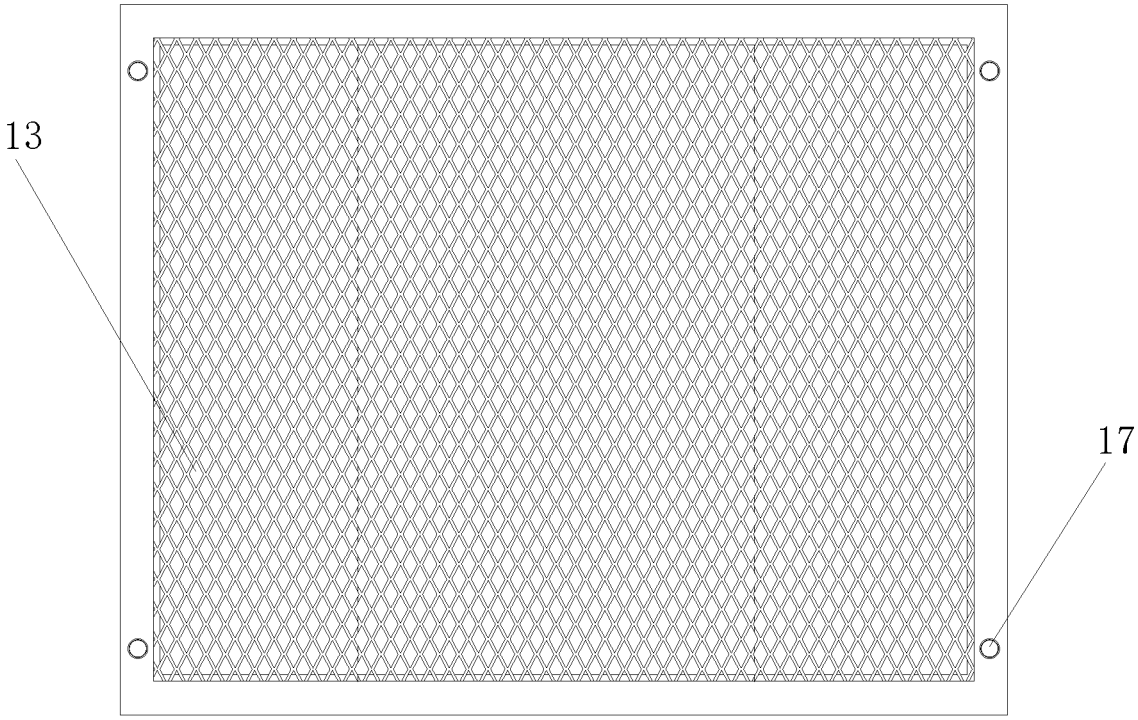
FIG. 17 is a schematic structural view of an upper frame of a multifunctional breathable storage cabinet according to the utility model.

As shown in FIG. 17, an upper frame 13 is of a metal mesh structure, and the bottom of the upper frame 13 is provided with a first opening 17 adapted to a first connecting piece 16.

Figure 18:
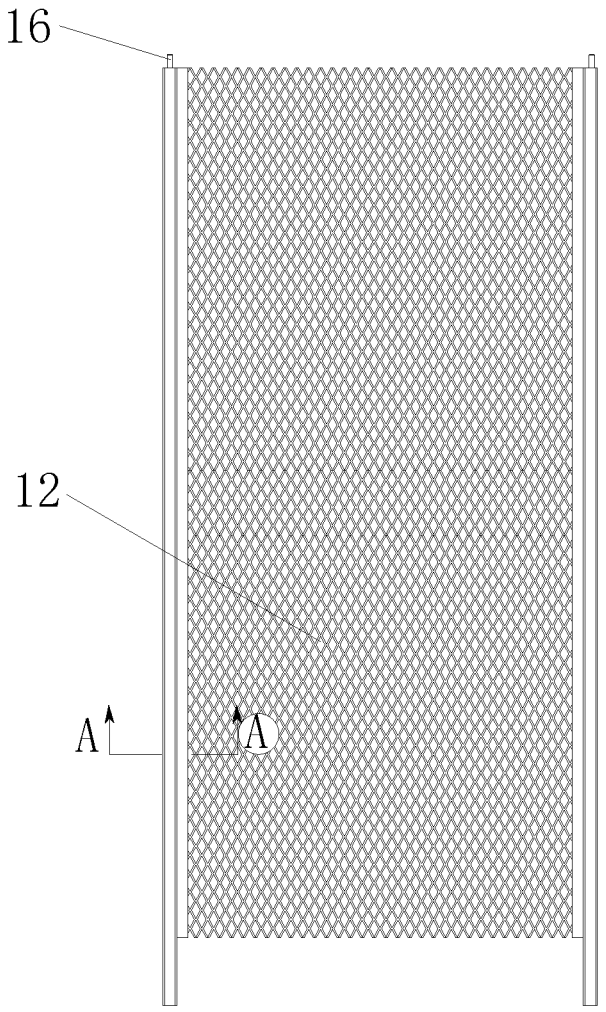
FIG. 18 is a schematic structural view of a left frame and a right frame of a multifunctional breathable storage cabinet according to the utility model.
Figure 19:
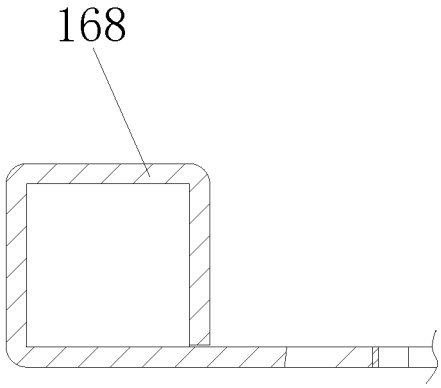
FIG. 19 is an enlarged cross-sectional view taken along a line A-A of FIG. 18.

As shown in FIGS. 18 and 19, the left frame 11 and the right frame 12 are each of a metal mesh structure, and two side edges of the left frame 11 and the right frame 12 are respectively bent to form hollow columnar supporting columns 168, so that the hollow columnar supporting columns 168 and the metal meshes are integrally formed.

As another implementation of the embodiment, the sliding rail 2 can be further provided with a storage laminate 3 capable of sliding along the sliding rail 2, so that the storage cabinet becomes a laminate type storage cabinet, and the storage laminate 3 may be a metal plate or a metal mesh, or a wood board or a glass plate.

Preferably, supporting feet 58 are further mounted at the bottom of the lower frame 14, and the supporting feet 58 may be fixed supporting feet or casters.

Preferably, the outer surface of each frame is provided with an electroplated layer or a baking varnish layer or a flocking layer to improve the service life and attractiveness of the storage cabinet.

Figure 3:
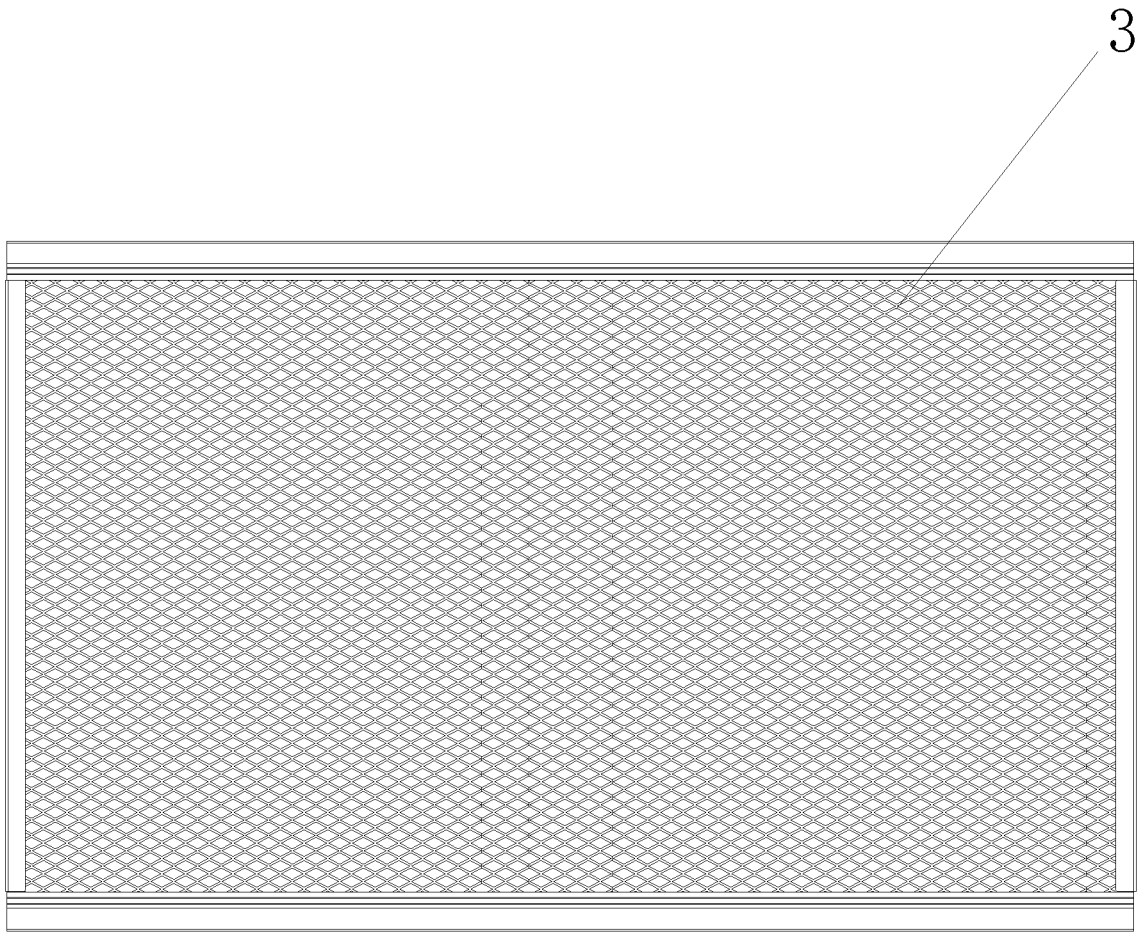
FIG. 3 is a schematic structural view of a storage laminate of a multifunctional breathable storage cabinet according to the utility model.

As shown in FIG. 3, the storage basket 4 can also be replaced, and a storage laminate 3 capable of sliding along the sliding rail 2 is mounted in the sliding rail 2, so that the multifunctional breathable storage cabinet becomes a laminate type storage cabinet.

Figure 24:
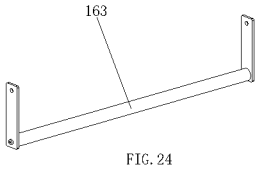
FIG. 24 is a schematic structural view of a coat hanger of a multifunctional breathable storage cabinet according to the utility model.

As shown in FIG. 24, coat hangers 163 can be further mounted on the upper portions of the left frame 11 and the right frame 12, storage laminates 3 or storage baskets 4 are mounted on the lower portions of the left frame 11 and the right frame 12, so that the storage cabinet has functions of clothes hanging and storage; door panels can be mounted on the left frame 11 and the right frame 12 to form a multifunctional closed type storage cabinet, and the door panels are metal plates or metal mesh plates, or wood boards or glass plates.

Embodiment 2

Figure 20:
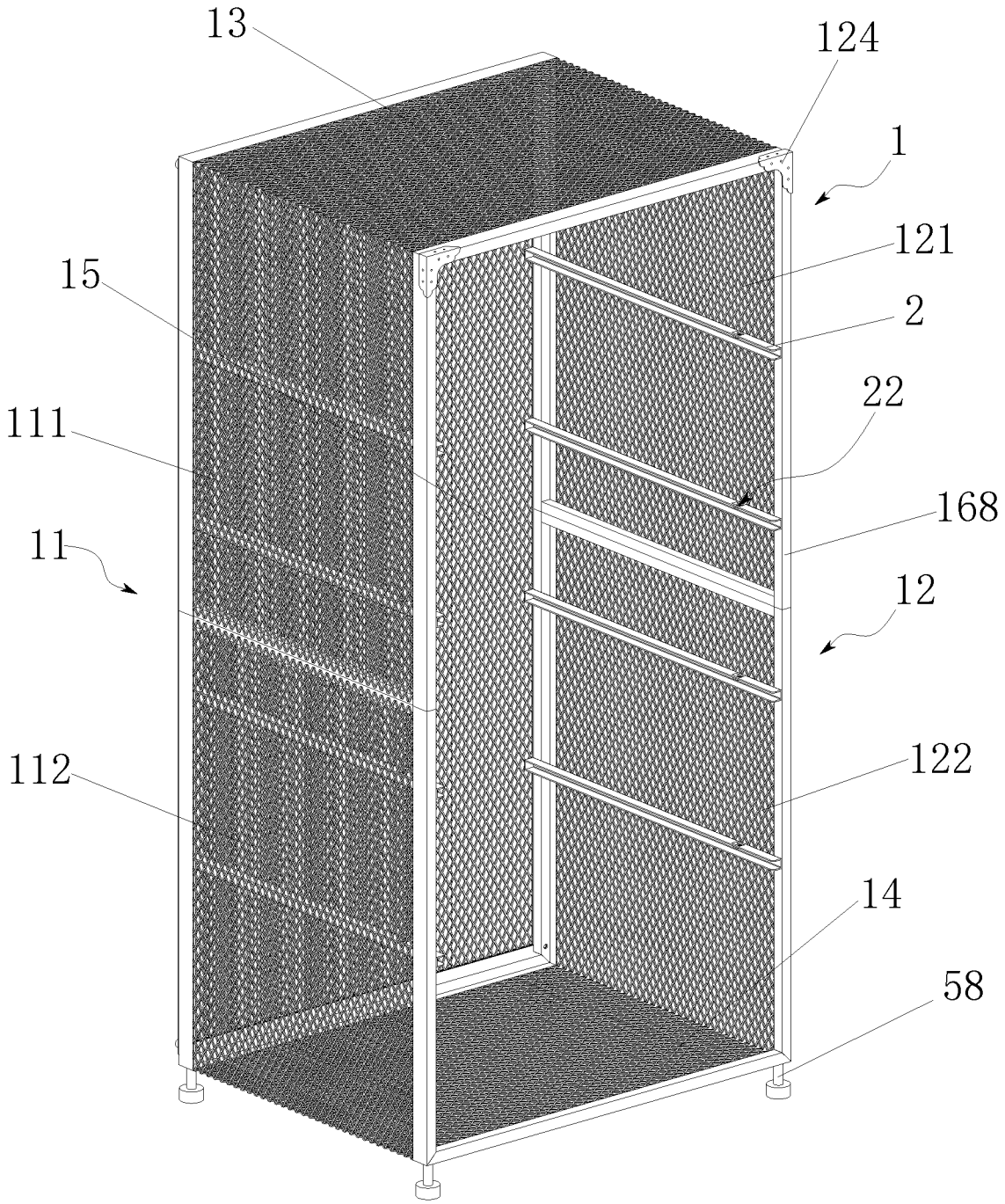
FIG. 20 is a stereoscopic schematic structural view of a multifunctional breathable storage cabinet without a storage basket according to Embodiment 2 of the utility model.
Figure 21:
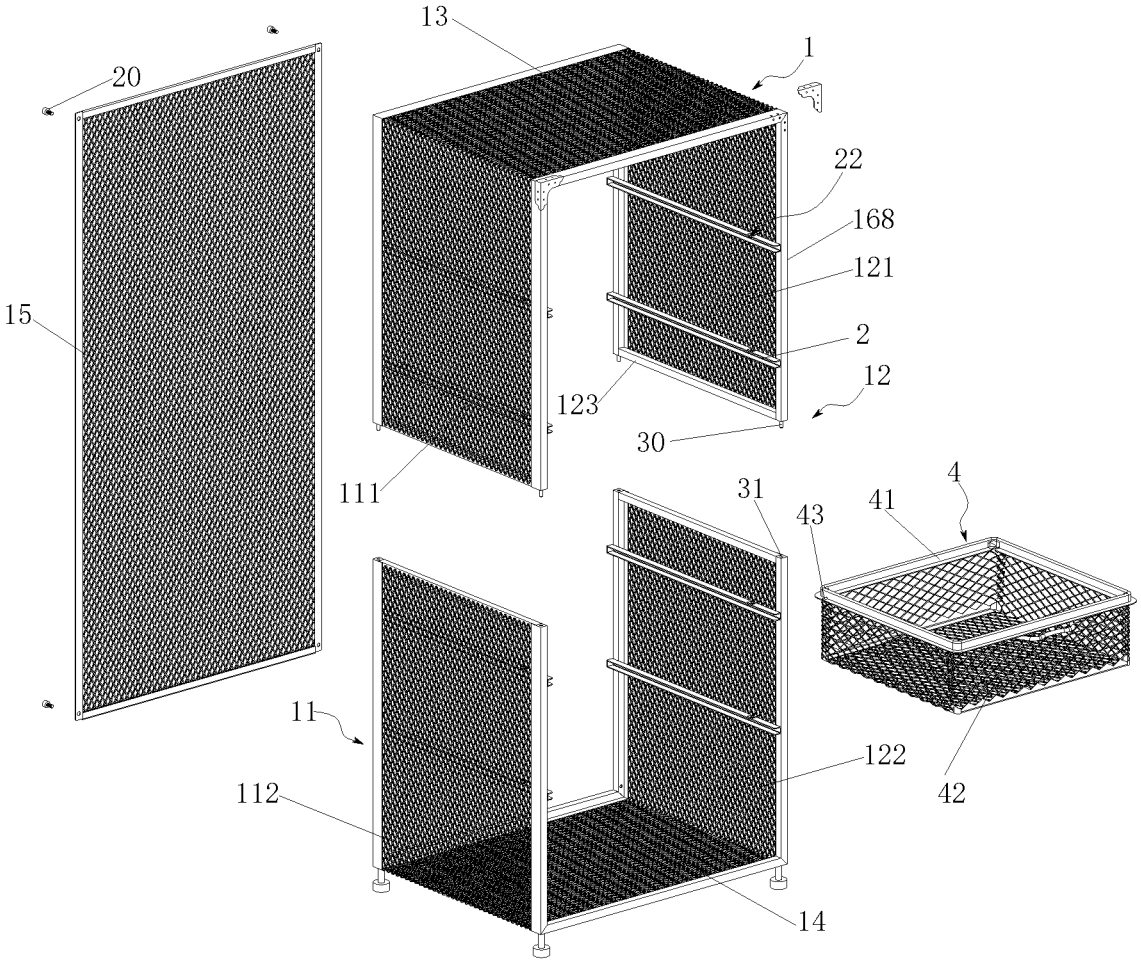
FIG. 21 is an exploded schematic structural view of a multifunctional breathable storage cabinet with a storage basket according to Embodiment 2 of the utility model.

Embodiment 2 differs from Embodiment 1 in that the structure of the frame body 1 is different, and other structures thereof are the same as those of Embodiment 1, which will not be repeated herein. As shown in FIGS. 20 and 21, in the embodiment, the frame body 1 further includes an upper frame 13, a lower frame 14 and a rear frame 15; the left frame 11 is formed by inserting a first left frame unit 111 and a second left frame unit 112, and the right frame 12 is formed by inserting a first right frame unit 121 and a second right frame unit 122; the first left frame unit 111, the upper frame 13 and the first right frame unit 121 are integrally bent into an inverse U shape through a metal mesh; the second left frame unit 112, the lower frame 14 and the second right frame unit 122 are integrally bent into a U shape through a metal mesh; the bottoms of the first left frame unit 111 and the first right frame unit 121 are respectively provided with at least one third connecting piece 30; the second left frame unit 112 and the second right frame unit 122 are provided with third openings 31 adapted to the third connecting piece 30; and the rear frame 15 is connected with the rear of the left frame 11 and the rear of the right frame 12 through fasteners 20. A U-shaped structure is adopted, which facilitates the forming of the frame body 1, and also facilitates the assembly and disassembly.

Reinforcing pipes 123 welded to the metal meshes are mounted at the end of the first left frame unit 111 corresponding to the second left frame unit 112 and the end of the first right frame unit 121 corresponding to the second right frame unit 122 respectively, so that the strength of the left frame 11 and the right frame 12 is enhanced.

Reinforcing parts 124 are mounted on a corner between the upper frame 13 and the first left frame unit 111 and a corner between the upper frame 13 of the first right frame unit 121, and the left frame 11 and the right frame 12 are connected more firmly with the upper frame 13 through the reinforcing parts 124.

Embodiment 3

Figure 22:
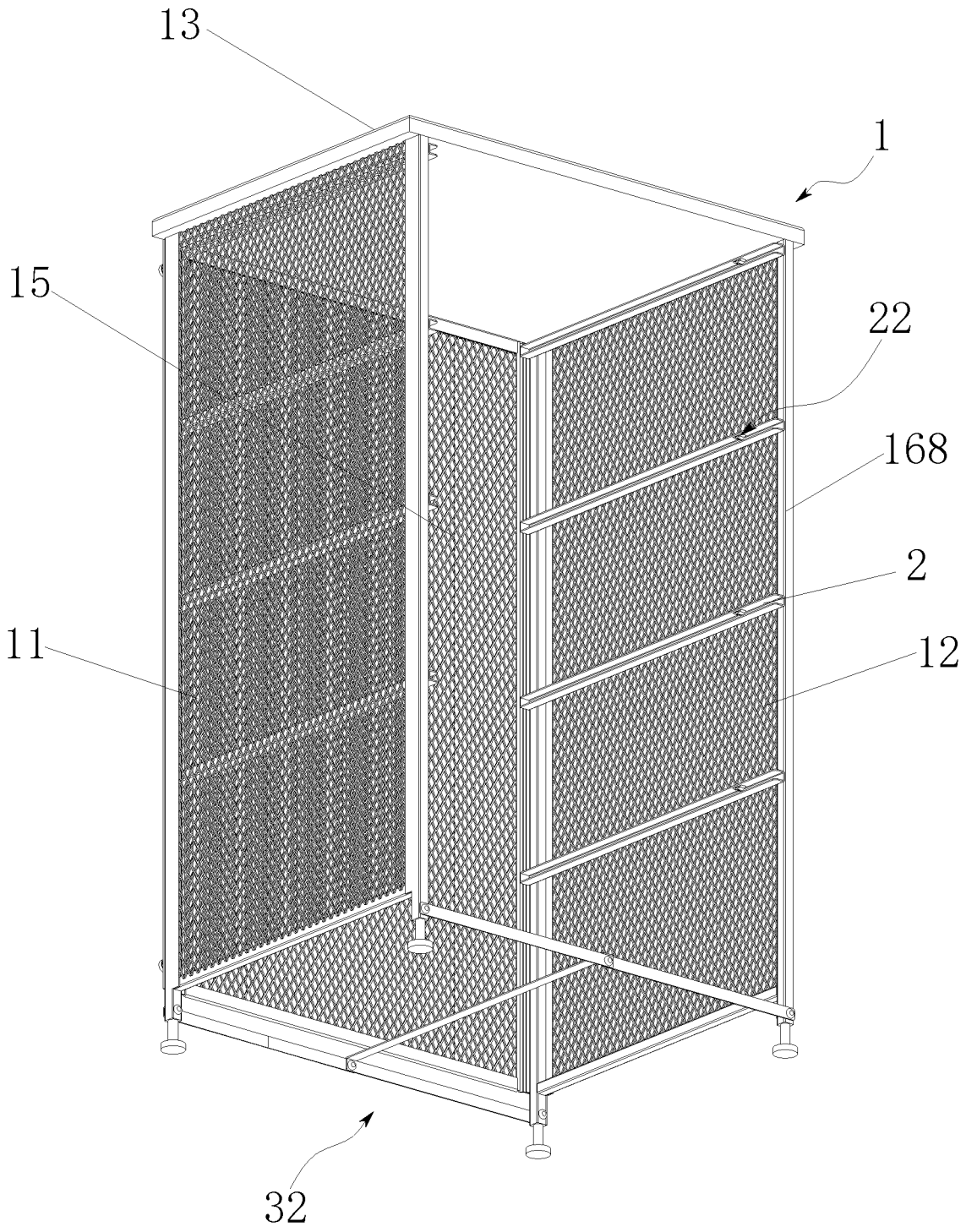
FIG. 22 is a stereoscopic schematic structural view of a multifunctional breathable storage cabinet without a storage basket according to Embodiment 3 of the utility model.
Figure 23:
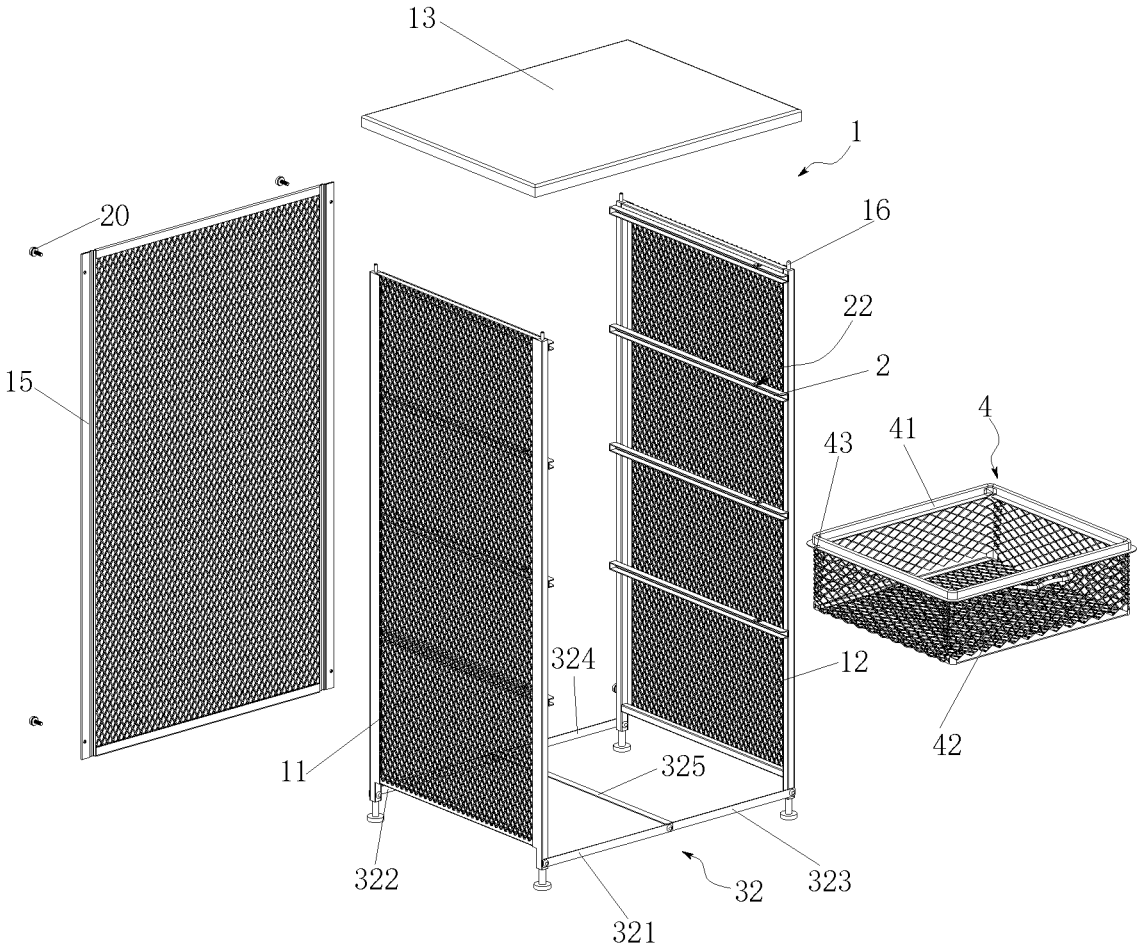
FIG. 23 is an exploded schematic structural view of a multifunctional breathable storage cabinet with a storage basket according to Embodiment 3 of the utility model.

Embodiment 3 differs from Embodiment 1 in that the structure of the frame body 1 is different, and other structures thereof are the same as those of Embodiment 1, which will not be repeated herein. As shown in FIGS. 22 and 23, in the embodiment, the frame body 1 further includes an upper frame 13 and a rear frame 15; the tops of the left frame 11 and the right frame 12 are respectively provided with at least one first connecting piece 16, the bottom of the upper frame 13 is provided with a first opening 17 adapted to the first connecting piece 16, and the first connecting piece 16 is inserted in the first opening 17 to connect the left frame 11 and the right frame 12 with the upper frame 13; connecting rod assemblies 32 capable of folding the left frame 11 and the right frame 12 are mounted on the lower portions of the left frame 11 and the right frame 12, and the rear frame 15 is connected with the rear of the left frame 11 and the rear of the right frame 12 through fasteners 20.

Preferably, the connecting rod assembly 32 comprises a first connecting rod 321, a second connecting rod 322, a third connecting rod 323, a fourth connecting rod 324, and a fifth connecting rod 325; one end of the first connecting rod 321 is hinged to the outer side of the lower portion of one side of the left frame 11, one end of the second connecting rod 322 is hinged to the outer side of the lower portion of the other side of the left frame 11, one end of the third connecting rod 323 is hinged to the outer side of the lower portion of one side of the right frame 12, and one end of the fourth connecting rod 324 is hinged to the outer side of the lower portion of the other side of the right frame 12; the other end of the first connecting rod 321 and the other end of the third connecting rod 323 are hinged to one end of the fifth connecting rod 325, and the other end of the second connecting rod 322 and the other end of the fourth connecting rod 324 are hinged to the other end of the fifth connecting rod 325, so that the left frame 11 and the right frame 12 can be folded.

In the embodiment, the upper frame 13 can also adopt an airtight plate-shaped structure, which may be a wood board, an iron plate or a glass plate.

In the embodiment, the connecting rod assembly 32 can also be designed to directly connect the left frame 11 and the right frame 12 by using two cross bars.

The above embodiments are preferred embodiments of the utility model, but the embodiments of the utility model are not limited by the above embodiments, and any other changes, modifications, substitutions, combinations and simplifications made without departing from the spirit and principles of the utility model all fall within the protection scope of the utility model.

What is claimed is:

1. A multifunctional breathable storage cabinet, comprising a frame body (1), wherein the frame body (1) comprises a left frame (11) and a right frame (12), and at least one set of sliding rails (2) is corresponding mounted on the left frame (11) and the right frame (12); a storage laminate (3) or a storage basket (4) capable of sliding along the sliding rail (2) is mounted on the sliding rail (2); one inward end of the sliding rail (2) is provided with a baffle (21), and the inner wall of one outward end of the sliding rail (2) is provided with an elastic limiting device (22); the storage basket (4) comprises a sliding connecting piece (41) capable of being inserted in the sliding rail (2) and capable of sliding along the sliding rail (2) and a metal mesh storage basket body (42) connected with the sliding connecting piece (41), and the sliding connecting piece (41) is provided with a limiting protrusion (43) capable of being in contact with the elastic limiting device (22) to limit the storage basket (4); the metal mesh storage basket body (42) is formed by bending and welding a metal mesh (44) with openings at four corners or formed by welding a first metal mesh (45), a second metal mesh (46) and a third metal mesh (47), and an upper edge of the metal mesh storage basket body (42) is inserted in an insertion groove (48) of the sliding connecting piece (41) and fixedly connected with the sliding connecting piece (41) or the upper edge of the metal mesh storage basket body is welded to the sliding connecting piece (41); the frame body (1) further comprises an upper frame (13) and a rear frame (15); the tops of the left frame (11) and the right frame (12) are respectively provided with at least one first connecting piece (16), the bottom of the upper frame (13) is provided with a first opening (17) adapted to the first connecting piece (16), and the first connecting piece (16) is inserted in the first opening (17) to connect the left frame (11) and the right frame (12) with the upper frame (13); connecting rod assemblies (32) capable of folding the left frame (11) and the right frame (12) are mounted on the lower portions of the left frame (11) and the right frame (12), and the rear frame (15) is connected with the rear of the left frame (11) and the rear of the right frame (12) through fasteners (20); the connecting rod assembly (32) comprises a first connecting rod (321), a second connecting rod (322), a third connecting rod (323), a fourth connecting rod (324), and a fifth connecting rod (325); one end of the first connecting rod (321) is hinged to the outer side of the lower portion of one side of the left frame (11), one end of the second connecting rod (322) is hinged to the outer side of the lower portion of the other side of the left frame (11), one end of the third connecting rod (323) is hinged to the outer side of the lower portion of one side of the right frame (12), and one end of the fourth connecting rod (324) is hinged to the outer side of the lower portion of the other side of the right frame (12); the other end of the first connecting rod (321) and the other end of the third connecting rod (323) are hinged to one end of the fifth connecting rod (325), and the other end of the second connecting rod (322) and the other end of the fourth connecting rod (324) are hinged to the other end of the fifth connecting rod (325).

2. The multifunctional breathable storage cabinet according to claim 1, wherein the elastic limiting device (22) comprises a first elastic piece (221) and a second elastic piece (222); one end of the first elastic piece (221) and one end of the second elastic piece (222) are connected to the sliding rails (2) respectively, and the other end of the first elastic piece (221) and the other end of the second elastic piece (222) are free ends.

3. The multifunctional breathable storage cabinet according to claim 1, wherein the rear frame (15) is of a metal mesh structure, two side edges of the rear frame (15) are respectively folded to form folded reinforcing portions (151), two side edges of the rear frame (15) are provided with arc-shaped concave portions (152) respectively, and V-shaped strips (153) for coating the upper end and the lower end of the rear frame are mounted at the upper end and the lower end of the rear frame (15) respectively.

4. The multifunctional breathable storage cabinet according to claim 1, wherein the outer side of the sliding connecting piece (41) is provided with a sliding portion (411) capable of being inserted in the sliding rail (2) and sliding on the sliding rail (2).

5. The multifunctional breathable storage cabinet according to claim 4, wherein the inner side of the sliding connecting piece (41) is provided with a convex edge (412) for supporting a cover.

* * * * *